US009671811B2

(12) United States Patent
Sim et al.

(10) Patent No.: US 9,671,811 B2
(45) Date of Patent: Jun. 6, 2017

(54) LOW-POWER BANDGAP REFERENCE VOLTAGE GENERATOR USING LEAKAGE CURRENT

(71) Applicant: POSTECH ACADEMY-INDUSTRY FOUNDATION, Pohang-si, Gyeongsangbuk-do (KR)

(72) Inventors: Jae Yoon Sim, Pohang-si (KR); Jong Mi Lee, Seoul (KR); Young Woo Ji, Seoul (KR)

(73) Assignee: POSTECH ACADEMY-INDUSTRY FOUNDATION, Pohang-si, Gyeongsangbuk-Do (KR)

( * ) Notice: Subject to any disclaimer, the term of this patent is extended or adjusted under 35 U.S.C. 154(b) by 0 days.

(21) Appl. No.: 15/150,564

(22) Filed: May 10, 2016

(65) Prior Publication Data

US 2016/0334826 A1 Nov. 17, 2016

(30) Foreign Application Priority Data

May 15, 2015 (KR) ..... 10-2015-0067942

(51) Int. Cl.
*G05F 3/08* (2006.01)

(52) U.S. Cl.
CPC ..... *G05F 3/08* (2013.01)

(58) Field of Classification Search
CPC ..... G05F 3/08; G05F 3/30
See application file for complete search history.

(56) References Cited

U.S. PATENT DOCUMENTS 6,507,179 B1 * 1/2003 Jun ..... G05F 3/30 323/313
8,026,709 B2 * 9/2011 Huang ..... G05F 3/30 323/312
9,519,304 B1 * 12/2016 Far ..... G05F 3/262
2004/0245975 A1 * 12/2004 Tran ..... G05F 3/30 323/313
2004/0245977 A1 * 12/2004 Tran ..... G05F 3/30 323/315
2006/0197584 A1 * 9/2006 Hsu ..... G05F 3/30 327/539
2008/0067996 A1 * 3/2008 Murase ..... G05F 3/30 323/316

(Continued)

FOREIGN PATENT DOCUMENTS

KR 10-2007-0082891 8/2007

OTHER PUBLICATIONS

Jong Mi Lee et al., "A 29nW Bandgap Reference Circuit"; 2015 IEEE International Solid-State Circuits Conference (ISSCC), Digest of Technical Papers; Feb. 23, 2015; pp. 100-102.

*Primary Examiner* — Matthew Nguyen
*Assistant Examiner* — Yusef Ahmed
(74) *Attorney, Agent, or Firm* — Kile Park Reed & Houtteman PLLC

(57) ABSTRACT

A low-power bandgap reference voltage generator using a leakage current may include: a medium voltage generation unit configured to generate a medium voltage based on the absolute temperature, using a leakage current; a low power amplifier configured to amplify the medium voltage and outputting an operational amplification voltage; and a reference voltage output unit configured to output a reference voltage based on the operational amplification voltage at a target level.

13 Claims, 10 Drawing Sheets

(56) References Cited

U.S. PATENT DOCUMENTS

2008/0136504 A1* 6/2008 Kim ..... G05F 3/30 327/539
2008/0157746 A1* 7/2008 Chen ..... G05F 3/30 323/313
2009/0051342 A1* 2/2009 Peng ..... G05F 3/30 323/313
2009/0189591 A1* 7/2009 Sperling ..... G05F 3/30 323/315
2009/0237150 A1* 9/2009 Tsai ..... G05F 3/30 327/539
2009/0243713 A1* 10/2009 Marinca ..... G05F 3/30 327/542
2009/0302824 A1* 12/2009 Kim ..... G05F 3/24 323/313
2010/0052643 A1* 3/2010 Cho ..... G05F 3/30 323/313
2010/0141344 A1* 6/2010 Kim ..... G05F 3/30 330/289
2010/0207597 A1* 8/2010 Yao ..... G05F 3/30 323/313
2012/0169413 A1* 7/2012 Choi ..... G05F 3/30 327/539
2013/0033305 A1* 2/2013 Fukazawa ..... G05F 1/567 327/539
2013/0257396 A1* 10/2013 Tung ..... G05F 3/30 323/265
2014/0022662 A1* 1/2014 Bibee ..... H03K 17/223 360/59
2014/0077791 A1* 3/2014 Zhang ..... G05F 3/30 323/314
2015/0207497 A1* 7/2015 Lee ..... H03K 5/003 327/307
2016/0091916 A1* 3/2016 Chang ..... G05F 1/46 323/268
2016/0246317 A1* 8/2016 Song ..... G05F 1/575
2016/0266598 A1* 9/2016 Wong ..... G05F 3/267

* cited by examiner

LOW-POWER BANDGAP REFERENCE VOLTAGE GENERATOR USING LEAKAGE CURRENT

BACKGROUND

1. Technical Field

The present disclosure relates to a technology for generating a bandgap reference voltage using a leakage current, and more particularly, to a low-power bandgap reference voltage generator using a leakage current, which is capable of generating a voltage proportional to the absolute temperature using a leakage current flowing in a state where a transistor is turned off, and operating at low power using an amplifier which operates below a threshold voltage.

2. Related Art

In general, a reference voltage generator refers to a circuit which generates a constant reference voltage in a semiconductor integrated circuit, regardless of an external environmental variation such as a surrounding temperature, process condition or external supply voltage.

Among a variety of reference voltage generators, a bandgap reference voltage generator refers to a circuit which independently outputs a constant reference voltage regardless of a surrounding temperature, supply voltage or process variation.

Recently, portable terminals operated through a battery have widely spread. Such portable terminals are required to operate at low power and low voltage. Thus, the bandgap reference voltage generator is also required to operate at low power and low voltage.

However, the conventional bandgap reference voltage generator has several obstacles to the operation at low power and low voltage. For example, the conventional bandgap reference voltage generator uses two operating points. For this configuration, a start-up circuit is used. The start-up circuit serves to help the bandgap reference voltage generator to maintain a stable operating point, when the bandgap reference voltage generator is switched from an idle mode to an operation mode or switched from the operation mode to the idle mode.

Since the conventional bandgap reference voltage generator uses the start-up circuit, there are difficulties in operating the conventional bandgap reference voltage generator at low power and low voltage.

SUMMARY

Various embodiments are directed to a low-power bandgap reference voltage generator using a leakage current, which is capable of generating a voltage proportional to the absolute temperature using a small amount of leakage current flowing when an inverse voltage is applied to a transistor, and operating at low power and low voltage, while omitting a start-up circuit.

In an embodiment, a low-power bandgap reference voltage generator using a leakage current may include: a medium voltage generation unit configured to generate a medium voltage based on the absolute temperature, using a leakage current; a low power amplifier configured to amplify the medium voltage and outputting an operational amplification voltage; and a reference voltage output unit configured to output a reference voltage based on the operational amplification voltage at a target level.

DETAILED DESCRIPTION

Figure 1:
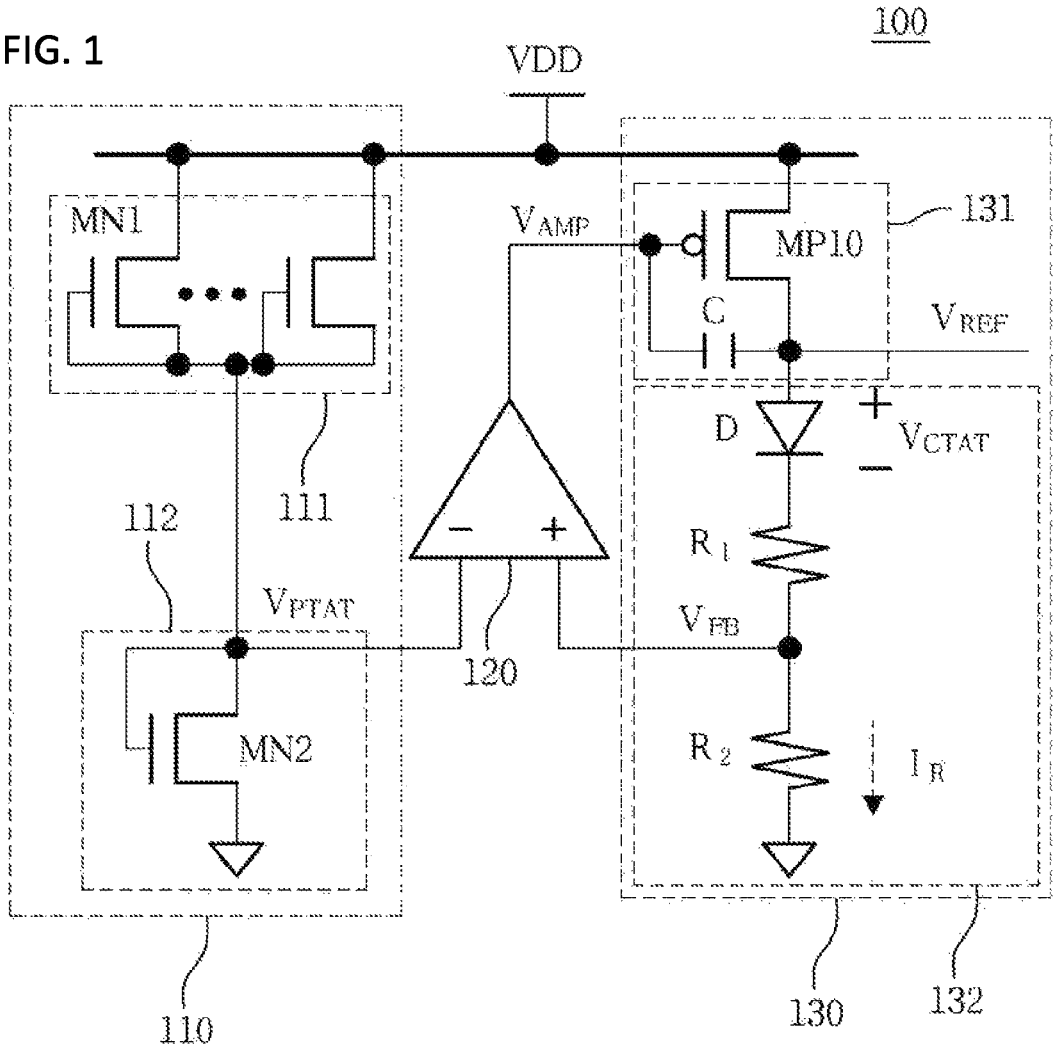
FIG. 1 is a diagram illustrating a low-power bandgap reference voltage generator using a leakage current in accordance with an embodiment.

Exemplary embodiments will be described below in more detail with reference to the accompanying drawings. The disclosure may, however, be embodied in different forms and should not be constructed as limited to the embodiments set forth herein. Rather, these embodiments are provided so that this disclosure will be thorough and complete, and will fully convey the scope of the disclosure to those skilled in the art. Throughout the disclosure, like reference numerals refer to like parts throughout the various figures and embodiments of the disclosure.

FIG. 1 is a diagram illustrating a low-power bandgap reference voltage generator using a leakage current in accordance with an embodiment. As illustrated in FIG. 1, the reference voltage generator 100 includes a medium voltage generation unit 110, a low power amplifier 120 and a reference voltage output unit 130.

The medium voltage generation unit 110 generates a medium voltage $V_{PTAT}$ proportional to the absolute temperature, using a leakage current flowing through transistors coupled in the form of a diode.

For this operation, the medium voltage generation unit 110 may include a leakage current output unit 111 and a medium voltage output unit 112. The leakage current output unit 111 includes a plurality of N channel MOS transistors MN1 of which the gates and sources are commonly coupled to the medium voltage $V_{PTAT}$ and which are coupled in parallel between a supply voltage VDD and the medium voltage $V_{PTAT}$, and outputs a leakage current. Hereafter, the plurality of N channel MOS transistors will be referred to as 'NMOS transistors'. The medium voltage output unit 112 includes an NMOS transistor MN2 of which the drain and gate are commonly coupled to the medium voltage $V_{PTAT}$ and which is coupled between the medium voltage VPTAT and a ground terminal, and outputs the medium voltage VPTAT corresponding to the leakage current outputted from the leakage current output unit 111.

The plurality of NMOS transistors MN1 have the same capacity (size), and operate below a threshold voltage of 0.5 to 0.6V.

The plurality of NMOS transistors MN1 included in the leakage current output unit 111 are configured in the form of a diode, while the gates and sources thereof are commonly coupled. The drains of the NMOS transistors MN1 are commonly coupled to the supply voltage VDD, and the gates and sources of the NMOS transistors MN1 are commonly coupled to the medium voltage $V_{PTAT}$. Thus, since the gate voltage and source voltage of the NMOS transistors MN1 have the same level, the plurality of NMOS transistors MN1 pass only a leakage current based on the absolute temperature in a region below the threshold voltage. Thus, only the leakage current based on the absolute temperature flows through the plurality of NMOS transistors MN1.

The gate and drain of the NMOS transistor MN2 included in the medium voltage output unit 112 are commonly coupled to the medium voltage $V_{PTAT}$, and the source of the NMOS transistor MN2 is coupled to the ground terminal. Thus, since the gate voltage and drain voltage of the NMOS transistor MN2 have the same level, a forward voltage is applied to the NMOS transistor MN2. In this state, the medium voltage $V_{PTAT}$ is outputted from the drain of the NMOS transistor MN2.

Since the NMOS transistors MN1 and MN2 are coupled according to the above-described structure, the level of the medium voltage $V_{PTAT}$ is determined by the leakage current flowing through the NMOS transistors MN1 and MN2.

The NMOS transistors MN1 and MN2 are operated below the threshold voltage, and the medium voltage VPTAT is not almost affected by the supply voltage VDD, but only increased in proportion to the absolute temperature. Furthermore, the amount of current flowing through the NMOS transistor MN2 corresponds to the total amount of leakage current flowing through the NMOS transistors MN1.

As a result, the medium voltage generation unit 110 outputs the medium voltage $V_{PTAT}$ proportional to the absolute temperature, using the leakage current which is generated in the above-described manner. Thus, the medium voltage generation unit 110 can be operated by low power. Furthermore, since the medium voltage generation unit 110 uses no additional circuit (start-up circuit) unlike a typical medium voltage generation unit, the power consumption thereof is reduced as much.

In the present embodiment, it has been described that the leakage current output unit 111 and the medium voltage output unit 112 were implemented with NMOS transistors. However, the present embodiment is not limited thereto, but the leakage current output unit 111 and the medium voltage output unit 112 may be implemented with P-channel MOS transistors or other transistors. Hereafter, the P-channel MOS transistors will be referred to as 'PMOS transistors'.

Figure 2A:
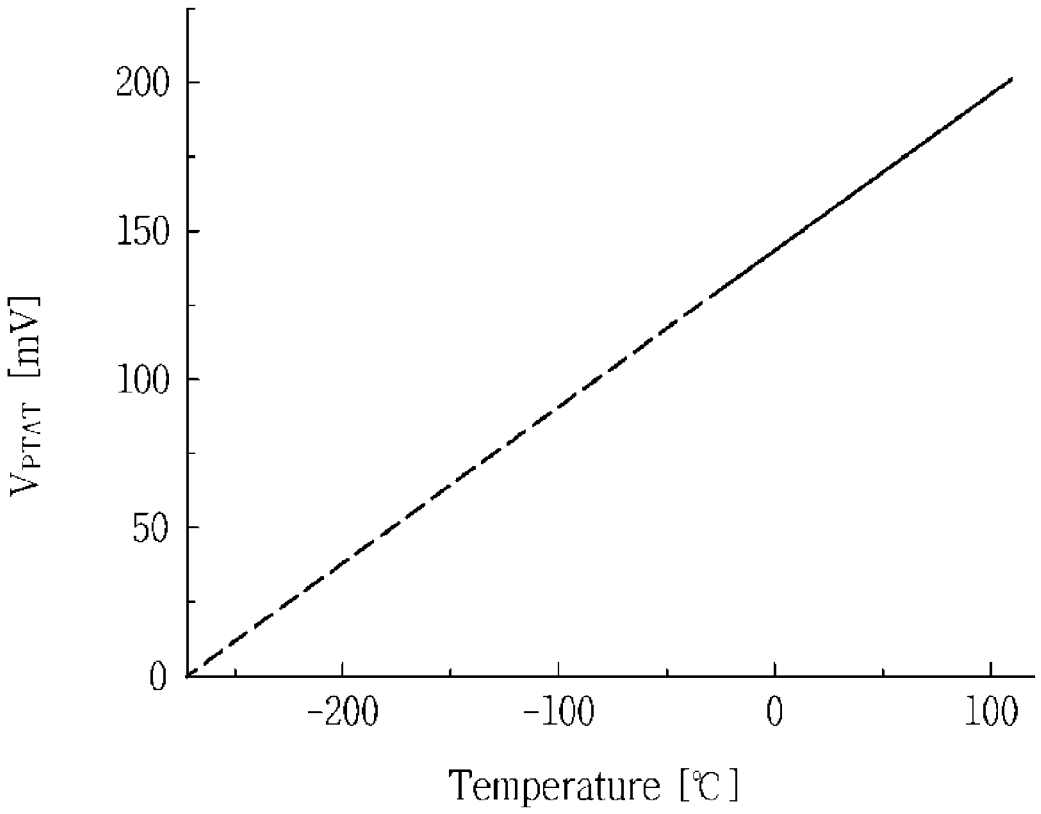
FIGS. 2A and 2B are graphs illustrating simulation results of a medium voltage and a leakage current.
Figure 2B:
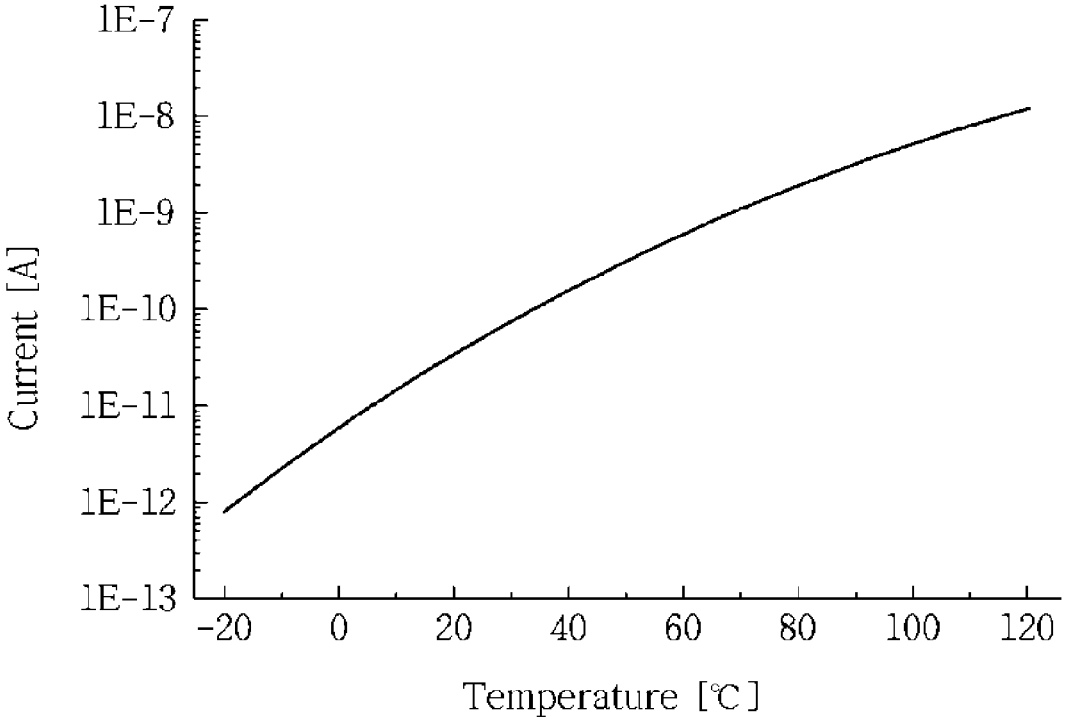

FIGS. 2A and 2B are graphs illustrating simulation results of the medium voltage $V_{PTAT}$ and the current (leakage current) which are changed in the medium voltage generation unit 110 according to temperature variations. That is, FIG. 2A illustrates that the medium voltage $V_{PTAT}$ increases in proportion to the absolute temperature, and FIG. 2B illustrates that the current also increases in proportion to the absolute temperature. In other words, as illustrated in FIGS. 2A and 2B, the reference voltage generator 100 is operated at low power within a temperature range which the reference voltage generator 100 is intended to use. Furthermore, the reference voltage generator 100 consumes a current of 60 pA at room temperature and consumes a low current of 13 nA at 120° C.

The low power amplifier 120 amplifies the medium voltage $V_{PTAT}$ supplied from the medium voltage generation unit 110 and outputs an operational amplification voltage $V_{AMP}$. Since the low power amplifier 120 is operated below the threshold voltage, the low power amplifier 120 is operated at lower power than a typical low power amplifier.

Figure 3:
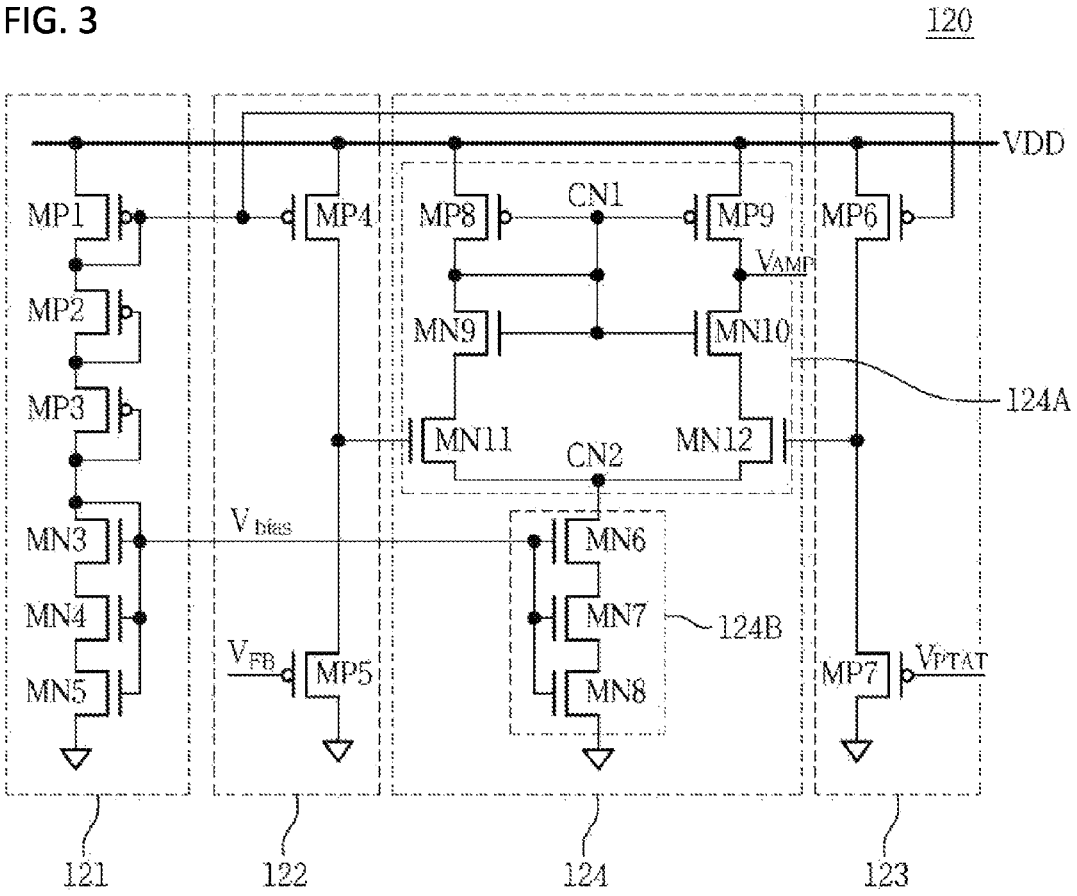
FIG. 3 is a detailed circuit diagram of a low power amplifier.

FIG. 3 is a detailed circuit diagram of the low power amplifier 120. As illustrated in FIG. 3, the low power amplifier 120 includes a bias circuit unit 121, a first input stage 122, a second input stage 123 and an operational amplification unit 124.

The bias circuit unit 121 includes PMOS transistors MP1 to MP3 and NMOS transistors NM3 to NM5 which are coupled in series between the supply voltage VDD and the ground terminal, and outputs a bias voltage $V_{bias}$. The PMOS transistors MP1 to MP3 are configured in the formed of a diode, while the gates and drains are commonly coupled. Thus, since a lower voltage than the threshold voltage is supplied to the gates and drains of the PMOS transistors MP1 to MP3, the low power amplifier 120 is operated at low power. The gates of the NMOS transistors NM3 to NM5 are commonly coupled to a node, and the common node is coupled to the drain of the PMOS transistor MP3. The bias voltage $V_{bias}$ is outputted from the common node.

The first input stage 122 serves to amplify (shift) the level of a feedback voltage $V_{FB}$ as a first input voltage to a predetermined level, such that the operational amplification unit 124 can perform a smooth amplification operation.

For this operation, the first input stage 122 includes PMOS transistors MP4 and MP5 which are coupled in series between the supply voltage VDD and the ground terminal. The gate of the PMOS transistor MP4 is commonly coupled to the gate of the PMOS transistor MP1, and the feedback voltage $V_{FB}$ is supplied to the gate of the PMOS transistor MP5.

Similarly, the second input stage 123 serves to amplify the level of the medium voltage $V_{PTAT}$ as a second input voltage to a predetermined level, such that the operational amplification unit 124 can perform a smooth amplification operation.

For this operation, the second input stage 123 includes PMOS transistors MP6 and MP7 which are coupled in series between the supply voltage VDD and the ground terminal. The gate of the PMOS transistor MP6 is commonly coupled to the gate of the PMOS transistor MP1, and the medium voltage $V_{PTAT}$ is supplied to the gate of the PMOS transistor MP7 from the medium voltage generation unit 110.

The operational amplification unit 124 includes an amplification unit 124A and a current sink 124B.

The amplification unit 124A includes PMOS transistors MP8 and MP9 and NMOS transistors MN9 to MN12. The PMOS transistor MP8 has a source coupled to the supply voltage VDD and a gate and drain commonly coupled a common node CN1, and the PMOS transistor MP9 has a source coupled to the supply voltage VDD, a gate coupled to the common node CN1, and a drain configured to output an operational amplification voltage $V_{AMP}$. The NMOS transistor MN9 has a drain and gate commonly coupled to the common node CN1, the NMOS transistor MN10 has a drain coupled to the drain of the PMOS transistor MP9 and a gate coupled to the common node CN1, the NMOS transistor MN11 has a drain coupled to the source of the NMOS transistor MN9 and a gate coupled to the drain of the PMOS transistor MP4, and the NMOS transistor MN12 has a drain coupled to the source of the NMOS transistor MN10 and a gate coupled to the drain of the PMOS transistor MP6.

The current sink 124B includes NMOS transistors MN6 to MN8 which are coupled in series between the ground terminal and a common node CN2 to which the sources of the NMOS transistors MN11 and MN12 are commonly coupled, and receive the bias voltage $V_{bias}$ through the gates thereof which are commonly coupled.

The amplification unit 124A amplifies the voltage supplied from the first and second input stages 122 and 123, and outputs the operational amplification voltage $V_{AMP}$. The current sink 124B serves to drive the amplification unit 124A. At this time, the current sink 124B may retain the operation region of the amplification unit 124A at a level equal to or less than the threshold voltage.

The reference voltage output unit 130 outputs a reference voltage $V_{REF}$ according to the operational amplification voltage $V_{AMP}$ outputted from the low power amplifier 120.

For this operation, the reference voltage output unit 130 includes a reference voltage generation unit 131 and a reference voltage feedback unit 132.

The reference voltage generation unit 131 includes a PMOS transistor MP10 and a capacitor C. The PMOS transistor MP10 has a gate coupled to the operational amplification voltage VAMP and a source and drain coupled between the supply voltage VDD and the reference voltage VREF, and the capacitor C is coupled between the gate of the PMOS transistor MP10 and the reference voltage VREF.

The reference voltage feedback unit 132 includes a diode D and resistors R1 and R2 which are coupled in series between the reference voltage VREF and the ground terminal.

Figure 4A:
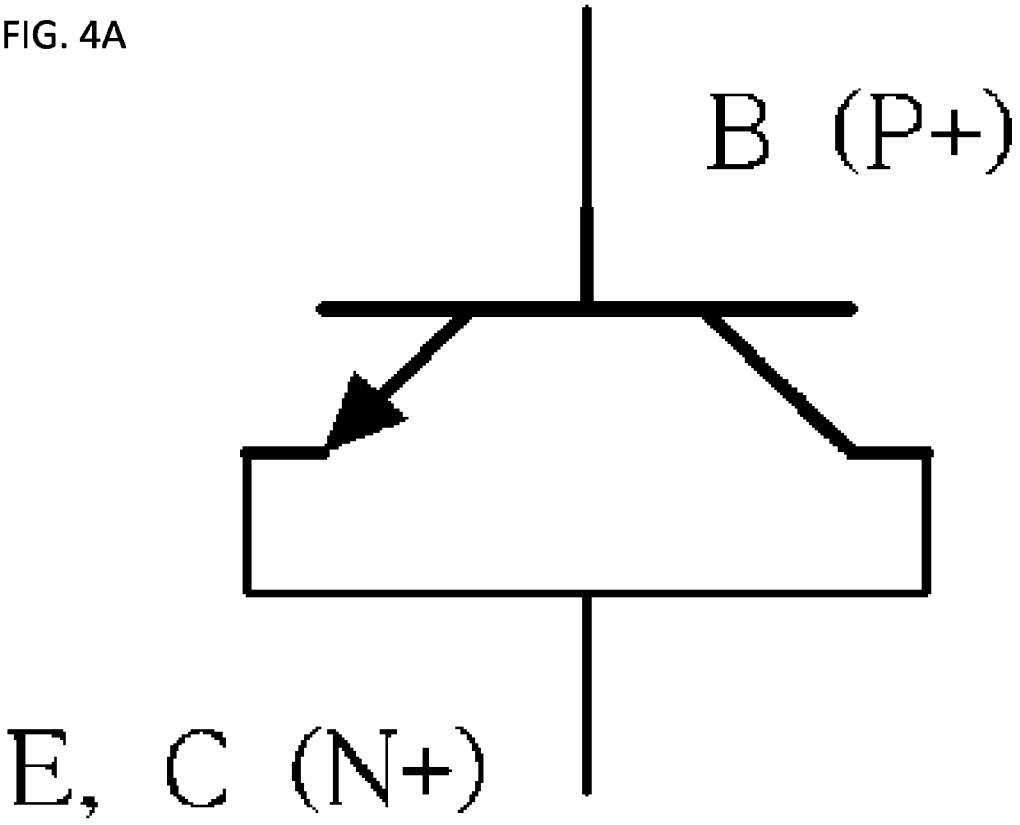
FIG. 4A illustrates a symbol representing a diode of FIG. 1 as a bipolar transistor.
Figure 4B:
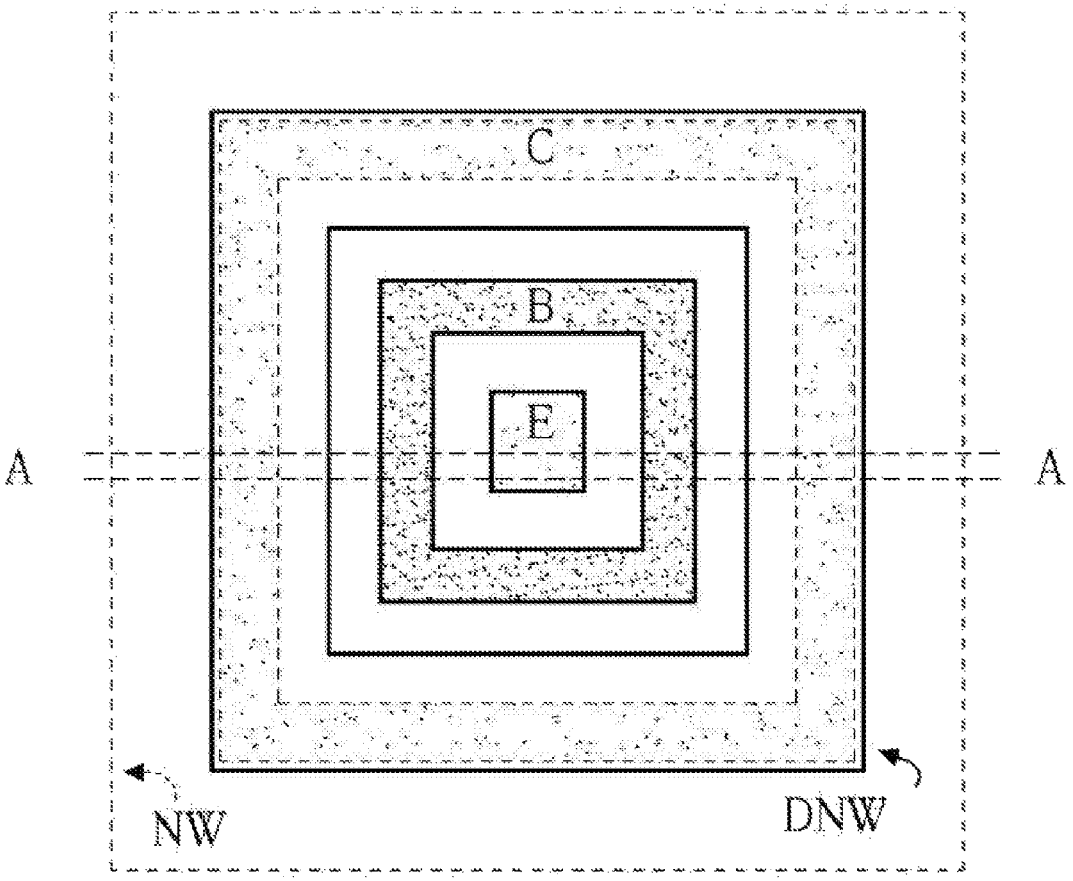
FIG. 4B is a plan view of the bipolar transistor.
Figure 4C:
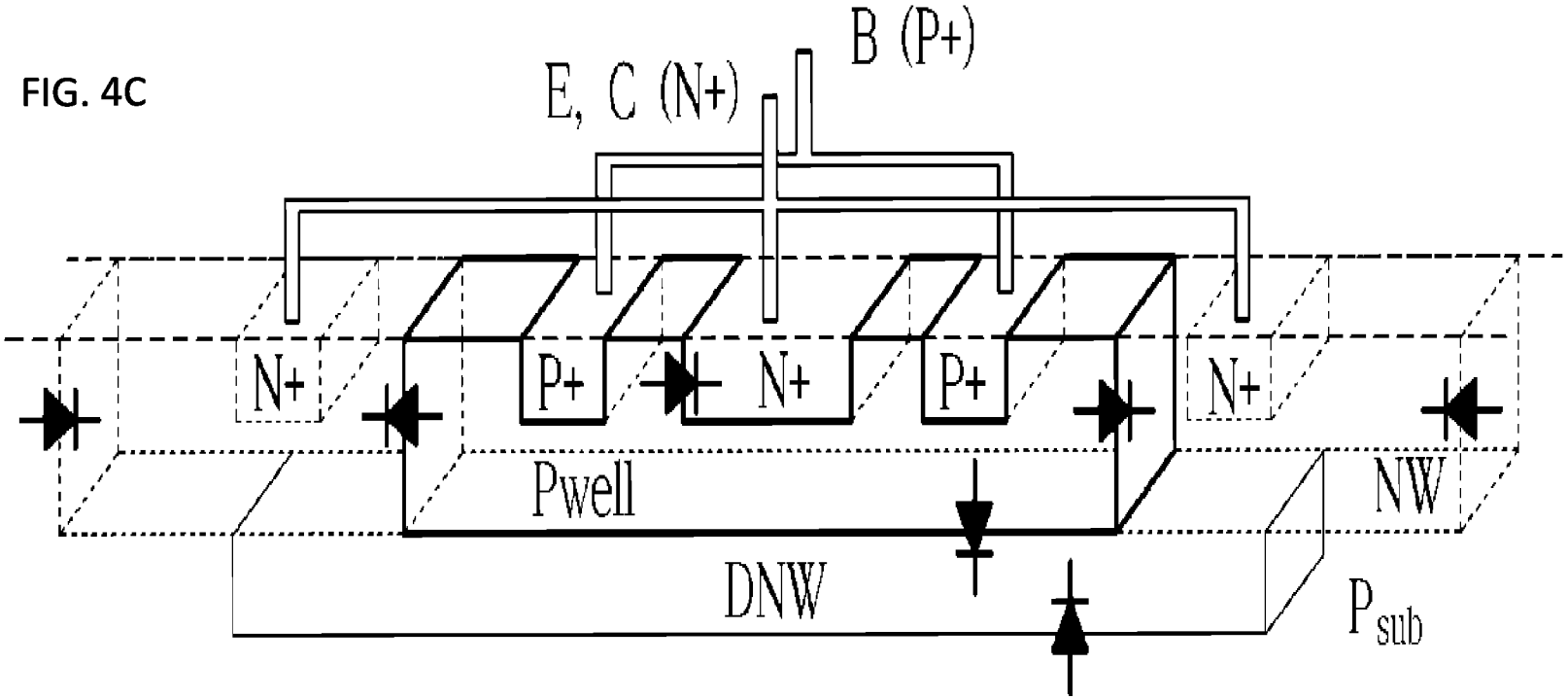
FIG. 4C is a structural diagram of the bipolar transistor based on line A-A of FIG. 4B.

The diode D may include an NPN-type BJT (Bipolar Junction Transistor). FIG. 4A illustrates a symbol representing the diode D as a bipolar transistor, FIG. 4B is a plan view of the bipolar transistor, and FIG. 4C is a structural diagram of the bipolar transistor based on line A-A of FIG. 4B, illustrating that the bipolar transistor includes two diodes having the NPN structure.

When the diode D is implemented with a PNP-type BJT, P-type doping of the emitter region needs to be coupled to a ground voltage. In the present embodiment, however, the diode D is implemented with an NPN BJT using a deep N-well (DNW), in order to omit the coupling to the ground voltage. Thus, when the reference voltage generator 100 is implemented with an integrated circuit, the diode D may be stacked over all or part of the resistors R1 and R2.

The PMOS transistor MP10 is operated by the operational amplification voltage $V_{AMP}$ outputted from the low power amplifier 120. Then, a current $I_R$ obtained through Equation 1 below is passed through the PMOS transistor MP10, the diode D and the resistors R1 and R.

$$I_R = \frac{V_{CTAT}}{R_2} \quad \text{[Equation 1]}$$

In Equation 1, $V_{CTAT}$ represents the absolute voltage applied across the diode D.

The current flowing through the diode D is not exponentially changed, but not almost changed in the region of use. The diode D serves to generate the absolute voltage $V_{CTAT}$ which decreases in proportion to the absolute temperature. For this operation, the diode D has the structure illustrated in FIGS. 4A to 4C. Thus, the absolute voltage $V_{CTAT}$ decreases with the increase of the absolute temperature. Since the characteristics of the resistors R1 and R2 are not almost changed by the surrounding temperature variation, the current $I_R$ increases according to the absolute temperature.

From the node to which the drain of the PMOS transistor MP10 and the anode of the diode D are coupled, a reference voltage VREF obtained through Equation 2 below is outputted.

$$V_{REF} = (R_1 + R_2) \cdot \frac{V_{CTAT}}{R_2} + V_{CTAT} \quad \text{[Equation 2]}$$

The capacitor C serves to perform a frequency compensation function such that the reference voltage generator 100 can be stably operated at any frequency.

Thus, the values of the resistors R1 and R2 may be properly set to output the reference voltage VREF at a target level. For this operation, the resistors R1 and R2 may be implemented with variable resistors, and coupled in series or parallel through a switch.

Figure 5A:
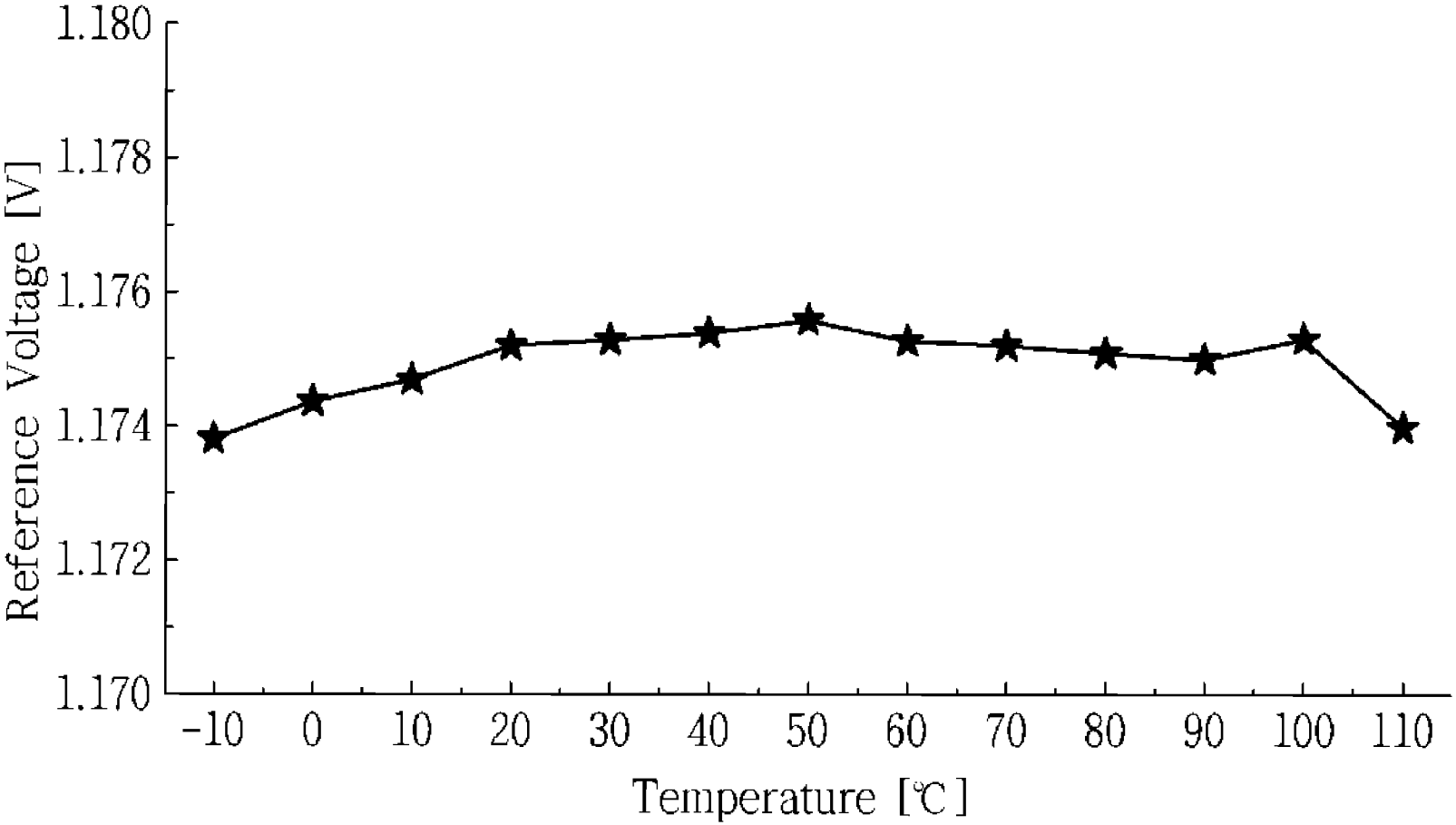
FIG. 5A is a graph illustrating the relationship between a reference voltage and temperature in accordance with the present embodiment.
Figure 5B:
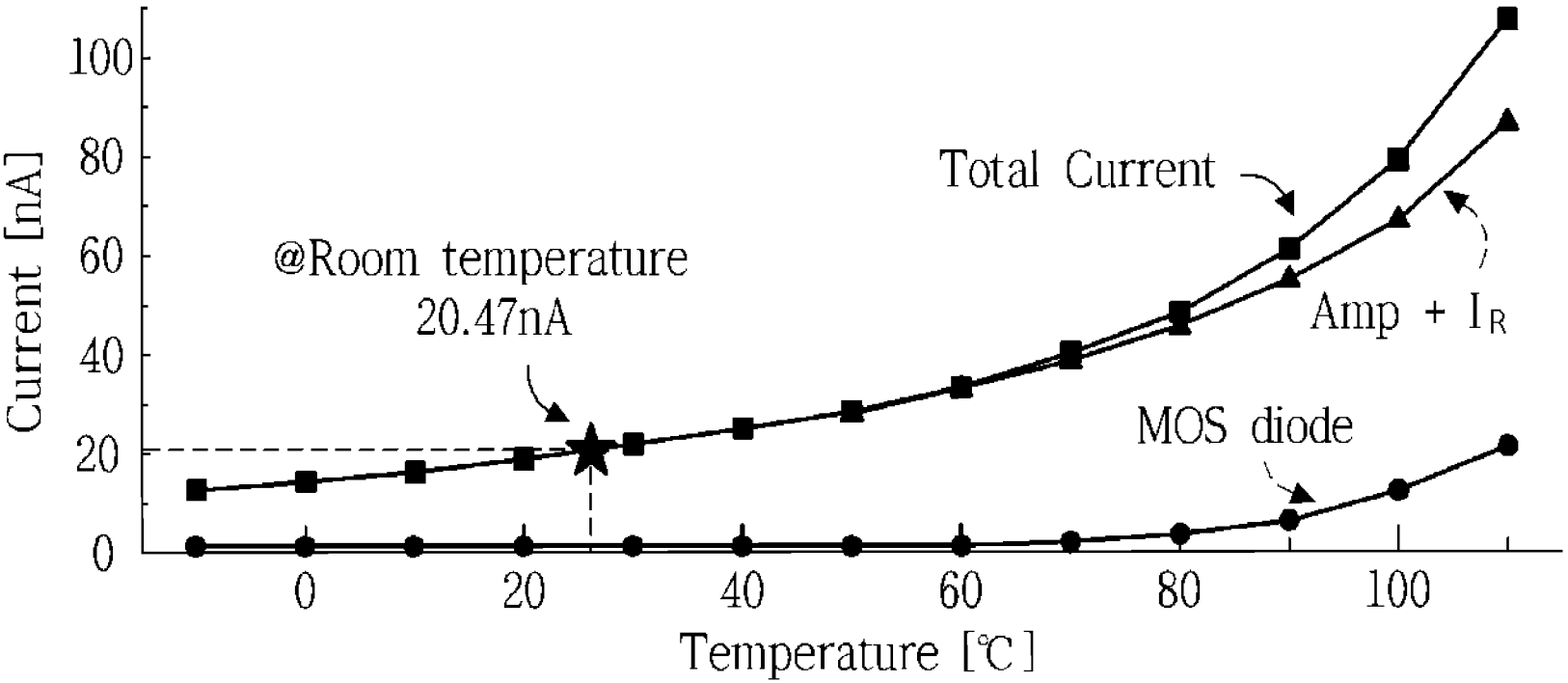
FIG. 5B is a graph illustrating the relationship between a current and temperature in accordance with the present embodiment.
Figure 5C:
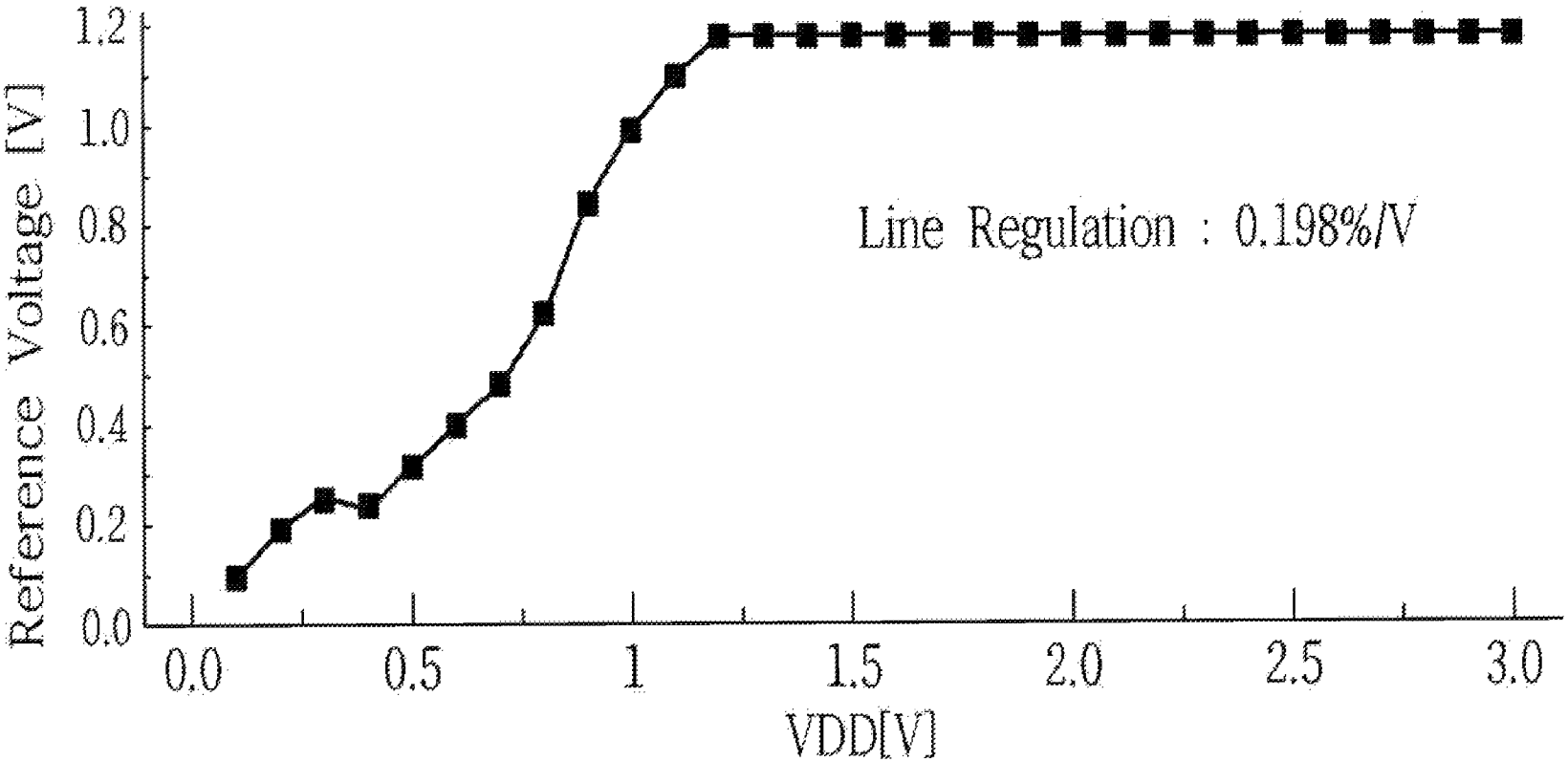
FIG. 5C is a graph illustrating the relationship between a reference voltage and a supply voltage in accordance with the present embodiment.

FIGS. 5A to 5C are diagrams illustrating the characteristics of the reference voltage and the current in accordance with the present embodiment.

Referring to FIGS. 5A to 5C, the low-power bandgap reference voltage generator in accordance with the present embodiment may generate a bandgap reference voltage of about 1.176V in a range of 10 to 110° C., and have a temperature dependency of about 12.75 ppm/° C.

The entire current consumption depending on temperature is only 20.47 nA at a temperature of 27° C., and a current required for generating a voltage which increases in proportion to temperature is only a part of the entire current.

Although most current is the current $I_R$ flowing through the resistors R1 and R2, the current consumption of the low power amplifier 120 increases exponentially with the increase of the temperature. Thus, the current consumption of the low power amplifier 120 at a temperature of 60° C. or more is considerably high. When the supply voltage is 1.4V, the reference voltage is not almost changed, and numerically checked at about 0.198%/V.

In accordance with the present embodiment, the low-power bandgap reference voltage generator can output the reference voltage using a small amount of leakage current flowing when an inverse voltage is applied to a transistor, and operate at low power and low voltage, thereby generating the reference voltage proportional to the absolute temperature while omitting a start-up circuit.

While various embodiments have been described above, it will be understood to those skilled in the art that the embodiments described are by way of example only. Accordingly, the disclosure described herein should not be limited based on the described embodiments.

What is claimed is:

1. A low-power bandgap reference voltage generator using a leakage current, comprising:

a medium voltage generation unit configured to generate a medium voltage based on the absolute temperature, using a leakage current;

a low power amplifier configured to amplify the medium voltage and outputting an operational amplification voltage; and a reference voltage output unit configured to output a reference voltage based on the operational amplification voltage at a target level, wherein the low power amplifier comprises:

a bias circuit unit configured to output a bias voltage;

a first input stage configured to amplify a feedback voltage to the target level;

a second input stage configured to amplify the medium voltage outputted from the medium voltage generation unit to the target level; and an operational amplification unit configured to amplify the voltage outputted from the first input stage and the second input stage, and output the operational amplification voltage, wherein the bias circuit unit comprises:

first to third PMOS transistors of which gates and sources are commonly coupled, and which are coupled in series between a supply voltage and the bias voltage; and third to fifth NMOS transistors of which gates are commonly coupled, and which are coupled in series between the bias voltage and a ground terminal.

2. The low-power bandgap reference voltage generator of claim 1, wherein the medium voltage generation unit comprises:

a leakage current output unit comprising transistors coupled in the form of a diode and configured to output a leakage current; and a medium voltage output unit configured to output the medium voltage having a level corresponding to the leakage current.

3. The low-power bandgap reference voltage generator of claim 2, wherein the leakage current output unit comprises a plurality of first NMOS transistors of which gates and sources commonly coupled, and which are coupled in parallel between the supply voltage and the medium voltage.

4. The low-power bandgap reference voltage generator of claim 2, wherein the medium voltage output unit comprises a second NMOS transistor of which a gate and source are commonly coupled to each other, and which is coupled between the medium voltage and the ground terminal.

5. The low-power bandgap reference voltage generator of claim 1, wherein the first input stage comprises fourth and fifth PMOS transistors coupled in series between the supply voltage and the ground terminal, and the feedback voltage is supplied to the gate of the fifth PMOS transistor.

6. The low-power bandgap reference voltage generator of claim 1, wherein the second input state comprises sixth and seventh PMOS transistors coupled in series between the supply voltage and the ground terminal, and the medium voltage is supplied to the gate of the seventh PMOS transistor.

7. The low-power bandgap reference voltage generator of claim 1, wherein the operational amplification unit comprises:

an amplification unit configured to amplify the voltage supplied from the first input stage and the second input stage, and outputting the operational amplification voltage; and a current sink configured to drive the amplification unit, and retaining an operation region of the amplification unit at a level equal to or less than a threshold voltage.

8. The low-power bandgap reference voltage generator of claim 7, wherein the amplification unit comprises:

an eighth PMOS transistor having a source coupled to the supply voltage and a gate and drain commonly coupled to a first common node;

a ninth PMOS transistor having a source coupled to the supply voltage, a gate coupled to the first common node, and a drain configured to output the operational amplification voltage;

a ninth NMOS transistor having a drain and gate commonly coupled to the first common node;

a tenth NMOS transistor having a drain coupled to the drain of the ninth PMOS transistor and a gate coupled to the first common node;

an eleventh NMOS transistor having a drain coupled to the source of the ninth NMOS transistor, a gate coupled to an output terminal of the first input stage, and a source coupled to a second common node; and a twelfth NMOS transistor having a drain coupled to the source of the tenth NMOS transistor, a gate coupled to an output terminal of the second input stage, and a source coupled to the second common node.

9. The low-power bandgap reference voltage generator of claim 7, wherein the current sink comprises sixth to eighth NMOS transistors of which their gates are commonly coupled and which are coupled between a second common node and the ground terminal, and receives the bias voltage through the gates so as to retain the operation region of the amplification unit at a level equal to or less than the threshold voltage.

10. The low-power bandgap reference voltage generator of claim 1, wherein the reference voltage output unit comprises:

a tenth PMOS transistor having a gate coupled to the operational amplification voltage and a source and drain coupled between the supply voltage and the reference voltage;

a capacitor coupled between the gate of the tenth PMOS transistor and the reference voltage; and a diode and first and second resistors which are coupled in series between the reference voltage and the ground terminal, and a feedback voltage outputted from a node to which the first and second resistors are commonly coupled is supplied to the other input terminal between both input terminals of the low power amplifier, excluding one input terminal to which the medium voltage is supplied.

11. The low-power bandgap reference voltage generator of claim 10, wherein the diode comprises a PNP-type BJT (Bipolar Junction Transistor).

12. The low-power bandgap reference voltage generator of claim 10, wherein the first and second resistors have a characteristic that is not changed by surrounding temperature variations.

13. The low-power bandgap reference voltage generator of claim 10, wherein the first and second resistors comprise variable resistors.

* * * * *